United States Patent [19]

Jensen

[11] Patent Number: 4,606,125

[45] Date of Patent: Aug. 19, 1986

[54] THROWING WEAPON

[76] Inventor: Harvey W. Jensen, 28128 Laura La Plante, Agoura Hills, Calif. 91301

[21] Appl. No.: 752,664

[22] Filed: Jul. 8, 1985

[51] Int. Cl.[4] ..... B26B 3/00

[52] U.S. Cl. ..... 30/302; 273/424; 30/299; 30/151

[58] Field of Search ..... 30/299, 102, 303, 302, 30/151, 152, 155, 307, 346.57; 273/424, 425

[56] References Cited

U.S. PATENT DOCUMENTS

| | | | |
|---|---|---|---|
| 4,027,389 | 6/1977 | Atchisson | 30/303 |
| 4,096,629 | 6/1978 | Levine | 30/152 |
| 4,543,721 | 10/1985 | Smith | 30/299 X |

FOREIGN PATENT DOCUMENTS

| | | | |
|---|---|---|---|
| 2522198 | 11/1976 | Fed. Rep. of Germany | 30/303 |

*Primary Examiner*—E. R. Kazenske
*Assistant Examiner*—Willmon Fridie, Jr.
*Attorney, Agent, or Firm*—Jack C. Munro

[57] ABSTRACT

A throwable weapon to be usable by a human being for self-defense which comprises a pair of plates connected together so that one plate can be pivoted relative to the other plate. When the one plate is pivoted relative to the other plate, a series of knife blades are caused to protrude circumferentially from the plates. When the weapon is subsequently thrown, the knife blades are capable of causing injury to a living body.

4 Claims, 5 Drawing Figures

THROWING WEAPON

BACKGROUND OF THE INVENTION

The field of this invention relates to defensive weapons and more particularly to a defensive weapon which is to be usable by a human being to protect oneself from physically being accosted.

There are numerous types of weapons for self-defense. Self-defense weapons are commonly used by individuals who are subjected to physical accostations such as being mugged. The desirable form of a self-defense weapon would be a firearm. However, within most municipalities, use of a firearm is prohibited.

Therefore, it is common to use some other form of self-defense mechanism. Certain individuals have taken up karate or judo. However, some types of people are not physically able to learn karate or judo. Also, some people may not be able to afford the time or expense to learn karate or judo.

Other types of defensive weapons may encompass something like a knife. However, to carry a knife blade represents a hazard not only to the assailant, but also to the user prior to being used.

A previously known type of defensive weapon is what is frequently termed a throwing star. The throwing star resembles the shape of a star in which each of the sharp points of the star constitutes a sharpened knife edge. Upon the item being thrown at the assailant, generally minor cutting of the assailant's body occurs upon being struck.

An inherent disadvantage of throwing stars of the prior art is that the knife blades are continuously exposed. Therefore, again the throwing star represents a hazard to the user prior to being used.

SUMMARY OF THE INVENTION

The primary objective of the present invention is to construct a throwing star which can be readily carried on one's person with the knife blades in a concealed position so as to eliminate any posibility of injury to the user.

Another objective of the present invention is to construct a throwing star which can be quickly and easily operated to cause the knife blade to extend making the throwing star available for usage.

The structure of the present invention relates to a pair of disc shaped plates which are mounted in juxtaposition and are connected together by a central axis. One plate can be rotated with respect to the other plate and upon doing so, through a gear assembly, will result in a plurality of knife blades to protrude circumferentially from the disc shaped plates. The weapon can then be thrown through the air at a prospective assailent to deter any aggressive act of the assailant. After usage, the plates again can be rotated in reverse relative to each other which will cause the knife blades to again retract to the concealed position.

DETAILED DESCRIPTION OF THE SHOWN EMBODIMENT

Figure 1:
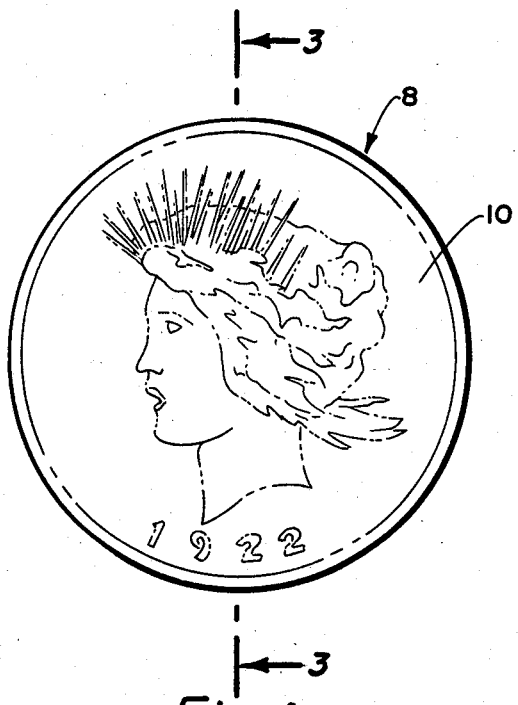
FIG. 1 is a top plan view of the throwing weapon of the present invention showing the throwing weapon in the shape as it would appear during non-usage.
Figure 2:
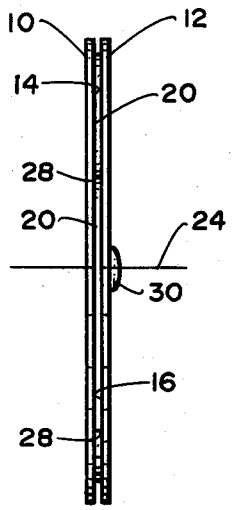
FIG. 2 is a side elevational view of the throwing weapon of the present invention.
Figure 3:
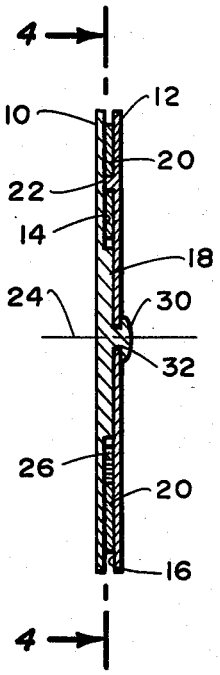
FIG. 3 is a cross-sectional view taken along line 3—3 of FIG. 1.

Referring particularly to the drawing there is shown the throwing weapon 10 of this invention which is composed generally of a first disc shaped plate 10 and a second disc shaped plate 12. It is to be noted that plate 10 is shown to have an exterior ornamental appearance such as resembling the face of a coin. However, it is to be understood that the exterior surfaces of both plates 10 and 12 could be configured to assume any desirable exterior appearance.

The plate 10 has an inner substantially planar surface 14. In a similar manner the plate 12 has an inner substantially planar surface 16. Centrally mounted onto the inner surface 14 is a drive gear 18.

Mounted on the inner surface 16 are a plurality of substantially teardrop shaped knife blades 20. The knife blades 20 are identical in configuration and each are attached by a pivot pin 22 to the structure of the plate 12. It is to be noted that there are shown to be five in number of knife blades 20. However, this number can be increased or decreased without departing from the scope of this invention.

The pivot pins 22 are equiangularly spaced apart about center axis 24. The aft end of each of the knife blades 20 includes a series of gear teeth 26. The gear teeth 26 are to be in continuous engagement with the drive gear 18. Each of the knife blades 20 terminate at its outer forward end into a sharp point 28.

A rivet 30 extends centrally from the gear 18 through a hole 32 formed within the plate 12. The outer end of the rivet 30 is expanded into an enlarged head which connects together the plates 10 and 12 in a permanent manner. However, it is to be understood that plate 12 can be rotated relative to plate 10 a limited angular amount.

Figure 5:
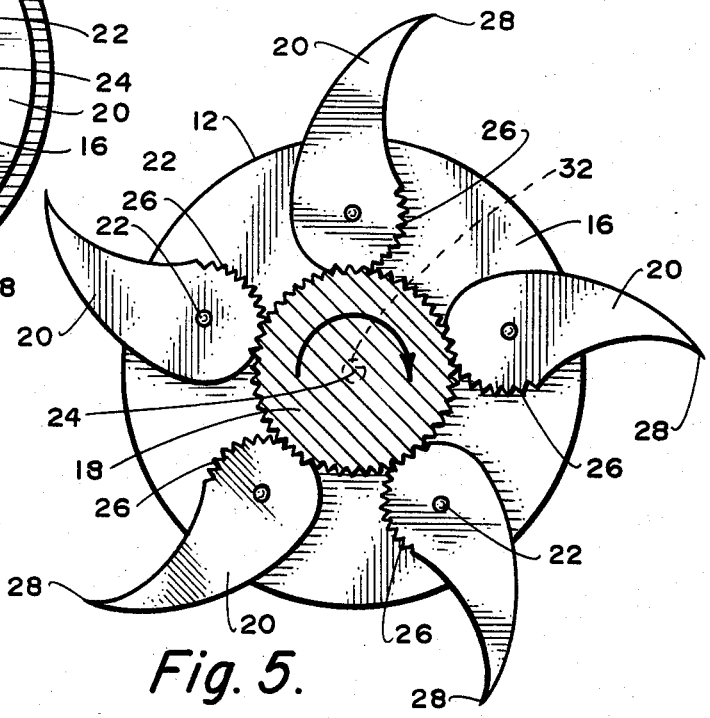
FIG. 5 is a view similar to FIG. 4 but showing the knife blades in the protruding position which constitutes the normal usage position for the weapon of the present invention.

In order to use the weapon 10 of this invention, the operator only need to place the disc 10 in contact with the palm of one's hand with the disc 12 to be in contact with the palm of one's other hand. The user then merely applies a twisting torque to the plates 10 and 12 which will result in the gear 18 being rotated relative to knife blades 20. Because of the engagement of the gear 18 with the gear teeth 26 of each knife blade 20, knife blades 20 are caused to protrude peripherally from the circumference of the weapon 10. This protrusion is clearly shown in FIG. 5. The weapon 10 is now ready to be used as by being thrown at an assailant.

Figure 4:
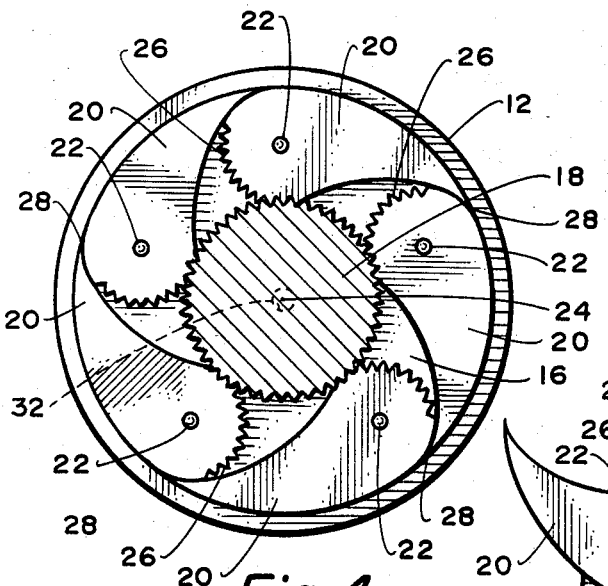
FIG. 4 is a cross-sectional view taken along line 4—4 of FIG. 3 showing in more detail the gear mechanism required to affect protruding of the knife blades of the throwing weapon of the present invention.

After usage, the user only needs to carefully place the plates 10 and 12 in contact with one's palms and reverse the rotation which will cause the blades 20 to move again to the retracted position shown in FIG. 4.

What is claimed is:

1. A throwing weapon comprising:

a first sheet material plate having a first planer inner surface, said first plate having a first center axis perpendicular to said first planar inner surface, said first plate having a drive gear mounted on said first planar inner surface, said drive gear having a center point located on said first center axis;

a second sheet material plate having a second planar inner surface, said second plate having a second center axis perpendicular to said second planar inner surface, said second plate being connected to said first plate with said first and second center axes coinciding, said second planar inner surface being located directly adjacent said first planar inner surface but spaced therefrom forming a gap; and a plurality a knife blades mounted within said gap, each said knife blade being pivotally mounted on said second plate, each said knife plate having a series of gear teeth, said gear teeth being in continuous contact with said drive gear, said knife blades being pivotable from a retracted position to an extended position by rotating said second plate relative to said first plate, said retracted position being when said knife blades are totally confined within said gap, said extended position being when said knife blades are protruding exteriorly of said gap.

2. The throwing weapon as defined in claim 1 wherein:

both said first plate and said second plate being generally disc shaped.

3. The throwing weapon as defined in claim 2 wherein:

the diameter of said first plate being substantially equal to the diameter of said second plate.

4. The throwing weapon as defined in claim 3 wherein:

each of said knife blades move simultaneously between said retracted position and said extended position.

* * * * *